United States Patent [19]

Perkins

[11] 4,171,634

[45] Oct. 23, 1979

[54] METHOD OF MAKING CORRUGATED TUBING WITH GRADUATED PITCH

[75] Inventor: Robert W. Perkins, Hamden, Conn.

[73] Assignee: Spiral Tubing Corporation, New Britain, Conn.

[21] Appl. No.: 837,717

[22] Filed: Sep. 29, 1977

[51] Int. Cl.[2] ..... B21D 15/04

[52] U.S. Cl. ..... 72/299; 72/371

[58] Field of Search ..... 72/299, 371, 64, 65; 57/94; 29/157.3 R

[56] References Cited

U.S. PATENT DOCUMENTS

| | | | |
|---|---|---|---|
| Re. 24,783 | 2/1960 | Humphrey | 72/299 |
| 2,876,616 | 3/1959 | Austin, Jr. et al. | 57/94 |
| 3,015,355 | 1/1962 | Humphrey | 72/299 |
| 3,117,471 | 1/1964 | O'Connell et al. | 72/299 |
| 3,533,267 | 10/1970 | Bunnell | 72/299 |
| 3,722,203 | 3/1973 | Akachi | 57/94 |
| 3,777,343 | 12/1973 | D'Onofrio | 29/157.3 R |
| 4,059,004 | 11/1977 | Perkins | 72/299 |

*Primary Examiner*—Lowell A. Larson

*Attorney, Agent, or Firm*—McCormick, Paulding & Huber

[57] ABSTRACT

Helically corrugated tubing with corrugations that have a gradually changing pitch from one end to the other is manufactured in a twisting machine by rotating one end of a deformable tube about the tube axis relative to the opposite end and simultaneously applying axially directed forces to the tube to progressively develop helical corrugations along the tube wall. The ratio of the torque and the axially directed forces applied to the tube is continuously varied to produce corresponding variations in the pitch of the corrugations. Tubing sections in which the pitch of the corrugations increases gradually from one end to the other are used in shell-and-tube or tube-in-tube heat exchangers and define flow paths having cross sectional areas which increase correspondingly.

16 Claims, 3 Drawing Figures

METHOD OF MAKING CORRUGATED TUBING WITH GRADUATED PITCH

BACKGROUND OF THE INVENTION

The present invention relates to helically corrugated tubing having a graduated pitch and the methods for manufacturing such tubing.

The manufacture of helically corrugated tubing is old in the art as indicated by U.S. Pat. Nos. 3,015,355 and 3,533,267. In general, a plain-walled tube having a cylindrical or other cross section is locally stressed at a plurality of points to weaken the tube and start the formation of the corrugations. The tube is installed in a twisting machine such as a lathe with one end of the tube engaged by a rotatable chuck in the headstock and the opposite end restrained against rotation by the tailstock. The chuck is then rotated to twist one end of the tube relative to the other, and at the same time axially directed forces are applied to the tube by pushing the tailstock toward the headstock. As indicated in U.S. Pat. No. 3,533,267, the rate of rotation of the tube relative to the rate of axial movement of the tailstock toward the headstock controls the shape and pitch of the corrugations.

The corrugations in tubes facilitate their use in many different areas particularly in the heat exchange field where one fluid passes within the tube in heat exchange relationship with another fluid on the outside of the tube. The corrugations in the tube wall increase the surface area of the tube per unit of tube length and also create turbulent flow inside and outside of the tube to improve heat transfer coefficients at the inner and outer tube surfaces.

Tubing units incorporating helically corrugated tubing can be formed by composites of both plain-walled and corrugated tubing as indicated in U.S. Pat. No. 3,730,229. In addition, shell-and-tube heat exchangers incorporate spiral tubing in tube bundles in order to gain the benefit of improved heat transfer coefficients in the bundle design.

In the prior art heat exchangers, the corrugations in the tubing are generally uniform from one end of the tube to the other and, correspondingly, the pitch and shape of the corrugations remain substantially the same from one end of the tube to the other. While such corrugations improve the heat transfer coefficients by virtue of the larger surface areas and induced turbulence, the cross sectional area of the tube remains unchanged as in a conventional tube and any changes in state or density of the fluid mediums are not accommodated. Increased pressure levels or velocities and backpressure are experienced.

It is, accordingly, a general object of the present invention to provide a new and novel helically or spirally corrugated tubing in which the corrugations are formed in a manner which accommodates the change in state or the natural contraction or expansion of fluids that receive or give up heat in an exchanger formed from the tubing. It is a further object of the invention to disclose a heat exchanger utilizing the new helically corrugated tubing.

SUMMARY OF THE INVENTION

The present invention concerns a metal tube having helical corrugations in the tube wall along at least one portion of the tube. The pitch of the helical corrugations varies gradually from one end to the other and generally increases or decreases constantly so that the pitch is graduated.

The invention entails the method of making corrugated tubing with a graduated pitch. A tube having a deformable tube wall disposed about the tube axis has pressures applied to the wall at locations corresponding to the corrugations desired. The tube is then twisted about its axis while axially directed forces are applied to the tube to cause the wall to deform and progressively develop spiral corrugations from the areas subjected to the localized pressure. The twisting torque and axially directed forces are controlled continuously to vary the pitch of the corrugations along the tube. In particular, the ratio of the torque and the axially directed forces is varied continuously at predetermined rates, and corresponding changes in the pitch and size of the corrugations take place.

Heat exchangers formed with the novel corrugated tubing define flow paths having variable cross sections which accommodate changes in pressure, density and velocity, particularly of gaseous mediums that are ducted through the exchangers. Improved functioning of the heat exchanger is obtained in spite of the change in characteristics of the medium receiving or giving up the heat.

DESCRIPTION OF THE PREFERRED EMBODIMENTS

Figure 1:
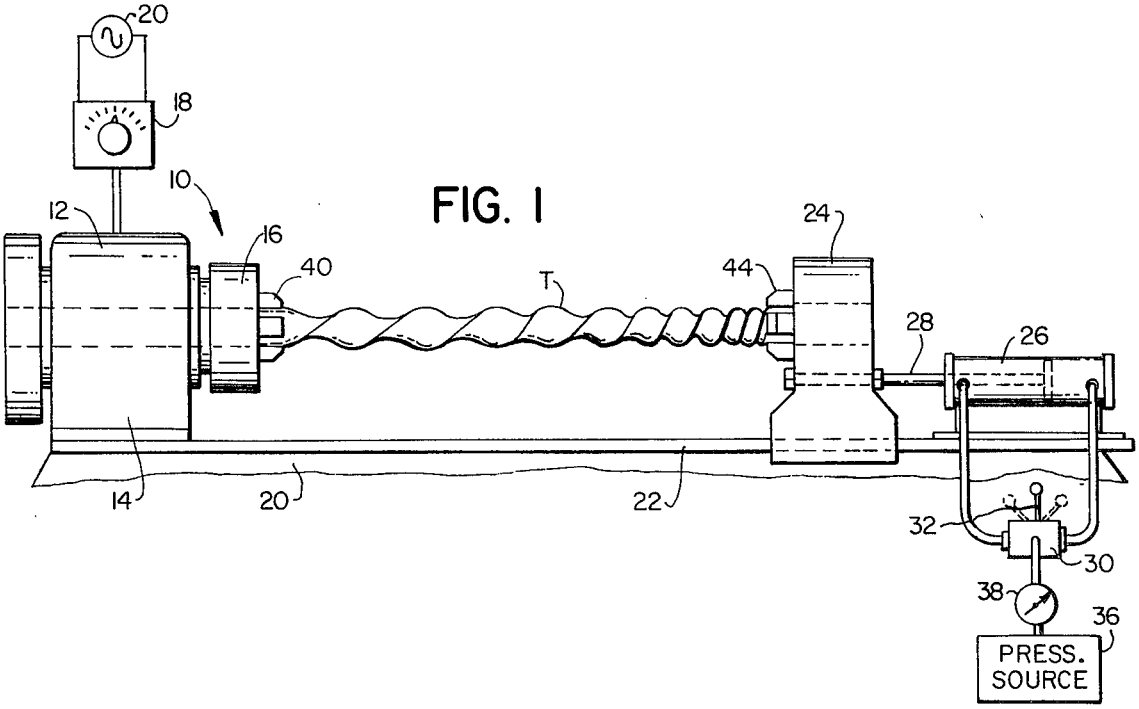
FIG. 1 is a side elevational view of a twisting machine for forming helically corrugated tubes with a graduated pitch.
Figure 2:
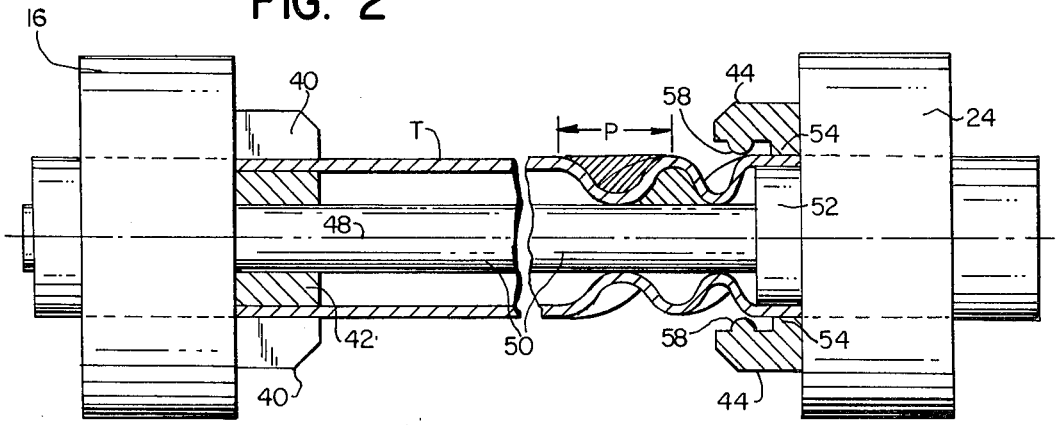
FIG. 2 is an enlarged fragmentary sectional view of a corrugated tube in the twisting machine during a twisting operation.

FIG. 1 illustrates a twisting machine such as a lathe which has been modified to accomplish the method of forming helical corrugations with graduated pitch in the wall of a deformable metal tube T in accordance with the present invention. For the purposes of this invention, pitch P is defined as shown in FIG. 2 and is the axial distance between the peaks of two adjacent corrugations.

The machine, generally designated 10 in FIG. 1, has a headstock 12 that includes a variable speed motor 14 and a rotatable chuck 16 connected in driving relationship for twisting the tube T. A speed regulator 18 derives a.c. power from a utility source 20 and is connected in controlling relationship with the motor 14 to regulate the speed at which the chuck 16 rotates. Variable speed motors and the controls for such motors are well known in the art, and therefore, a more detailed description of the motor and regulator is not provided. It is sufficient to understand that adjustment of the regulator 18 manually or automatically results in a corresponding change in the rotational speed of the chuck 16. The regulator 18 provides infinitely variable speed changes; however, controls providing incremental or stepped speed changes with sufficient resolution for graduating the corrugations as described in greater detail below may also be used.

The headstock 12 is fixedly mounted on the bed 20 of the lathe and the bed includes a set of ways 22 on which a tailstock 24 is mounted for sliding movement toward and away from the headstock. A pneumatic or hydraulic ram 26 is fixedly connected to the bed 20 and includes a piston 28 connected to the tailstock 24 so that the tailstock can be pushed on the ways toward and away from the headstock in response to a ram control valve 30 connected between the ram and a source 36 of pneumatic or hydraulic pressure. In this manner, axially directed forces are applied to the tube T. The valve may be manually controlled by means of the handle 32 to remove and reverse the forces developed by the ram on the tailstock 24.

A pressure regulator 38 is interposed between the valve 30 and the pressure source 36. The regulator controls the pressure at which the ram 26 operates and correspondingly the axial force applied to the tube T through the tailstock 24.

In the corrugation forming process, the deformable metal tube T formed of copper, aluminum or other elements and alloys is installed in the twisting machine between the rotatable chuck 16 of the headstock 12 and the tailstock 24. For this purpose, the chuck 16 is provided with clamping jaws 40 shown in FIG. 2 which engage the one end of the tube. Initially, the tube walls are not deformed and, in the illustrated case, have an annular shape of circular cross section. To prevent the pressure of the jaws 40 from collapsing the tube walls, a bushing 42 having an outside diameter equal to the inside diameter of the tube wall is installed within the tube and jaws of the chuck 16.

Figure 3:
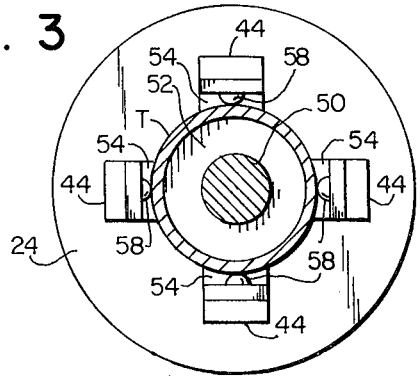
FIG. 3 is a sectional view of the twisting machine and tube as seen along the sectioning line 3—3 in FIG. 2.

The opposite end of the tube T is restrained against rotation about the tube axis 48 by the jaws 44 of the tailstock 24 shown in FIGS. 2 and 3. To prevent the tube walls from collapsing under the pressure of the jaws 44, a specially shaped mandrel 50 is mounted within the tube. An enlarged portion 52 of the mandrel equal to the inside diameter of the tube is positioned directly under the shoes or pressure pads 54 of the jaws. The remaining portion of the mandrel extending substantially the entire length of the tube between the jaws 40 and 44 has a reduced diameter and extends through the bushing 42 and the rotatable chuck 16. The bushing aligns the mandrel coaxially within the tube T and also insures that the end of the tube engaged by the jaws 40 of the chuck 16 rotates freely relative to the mandrel which is clamped and restrained against rotation by means of the jaws 44 in the tailstock. The reduced diameter portion of the mandrel limits the inward deformation of the corrugations as described in greater detail below.

In addition to the shoes 54, the jaws 44 of the tailstock include pimples 58 which develop localized pressure at circumferentially spaced areas on the outside of the tube when the jaws are closed. Such localized pressure may or may not plastically deform the tube wall, but is needed to develop local stresses which reduce the resistance of the tube wall to deformation and thus aid in starting the formation of corrugations in the tube in the axial plane in which the pimples 58 are located. For a further description of this process, reference may be had to co-pending application Ser. No. 659,845, filed Feb. 20, 1976, by Robert W. Perkins.

To generate corrugations in the tube after the tube has been installed in the machine 10, the chuck 16 is rotated and axially directed forces are applied to the tailstock 24 by means of the ram 26. Thus, one end of the tube mounted in the chuck 16 is twisted relative to the other end in the tailstock and compression or tension forces are simultaneously applied axially of the tube. The combined stresses resulting from the twisting and axially directed forces cause the tube wall to deform at weakened areas. Deformations develop first at the areas of localized pressure under the pimples 58, and since the enlarged portion of the mandrel 52 prevents the deformation of the overlying tube wall, the deformations grow helically away from the tailstock toward the headstock and progressively form the corrugations. The reduced diameter portion of the mandrel limits the inward deformation or valleys of the corrugations. By controlling the ratio of the torque produced on the tube by twisting and the axially directed forces, the pitch and width of the peaks and valleys of the corrugations are controlled.

Control of the torque/force ratio is obtained by varying the setting of the speed regulator 18 or the pressure regulator 38 or both regulators in combination. For example, the corrugations illustrated in the tube of FIG. 1 have a graduated pitch which increases continuously and substantially constantly or linearly from the one end of the tube mounted in the tailstock 24 to the opposite end mounted in the chuck 16. Such graduation of the pitch may be obtained by setting the pressure regulator 38 at a fixed value in order to apply a relatively constant force to the tube T from the ram 26, and varying the rate of chuck rotation so that the one end of the tube is twisted at slower and slower rates established by the regulator 18 as the corrugations progressively develop in the tube wall from the tailstock 24 toward the chuck.

Alternatively, the fluid pressure delivered to the ram 26 from the pressure source 36 is varied gradually to lower and lower levels by the regulator 38 which reduces the axial forces as the corrugations progressively develop along the tube. Since the axially directed forces developed by the ram 26 control the rate at which the tailstock moves toward the headstock 12, the regulator 38 also controls such rate. Thus, corrugations adjacent the tailstock are developed with smaller pitch and tighter peaks and valleys than those adjacent the headstock.

Obviously, combined variations in chuck rotation and tailstock movement can be used to achieve the same or other pitch graduations. The rate of change of the parameters is, in general, always in the same sense or direction, that is, increasing or decreasing, to produce constantly increasing or decreasing pitch.

In FIG. 2 the cross sectional area between adjacent corrugations in the tube is shaded both externally and internally of the tube. Such cross sectional areas vary in accordance with the pitch of the corrugations. This variation is advantageously employed in heat exchangers where the fluid medium passing through or over conduits formed by corrugated tubing experiences a substantial change in density or pressure due to the heat received or given up in the heat transfer process. For example, if a gaseous medium flows through a corrugated tube having graduated pitch and receives heat, the spiral paths within the larger flutes or corrugations define a flow path of larger cross sectional area. Therefore, if a gas to be heated enters the convolutions within a corrugated tube where the pitch of the corrugations is small and leaves the tube where the pitch is large, the natural expansion of the gas due to the heat received can be accommodated by the graduated corrugations as the gas passes through the tube. The same effect can be observed when the gas flows through the convolutions on the exterior of the tube. Also, if heat is withdrawn from the gas and the gas flows from the larger to the smaller corrugations, the natural contraction of the gas can be accommodated.

Figure 4:
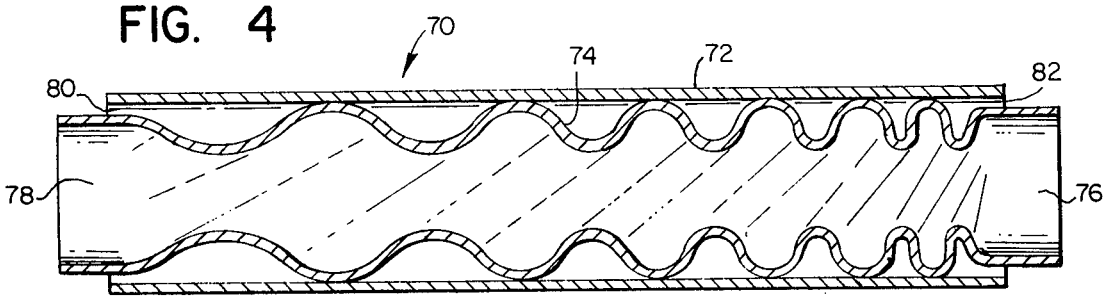
FIG. 4 is a cross sectional view of a heat exchanger employing a helically corrugated tube with graduated pitch.
Figure 5:
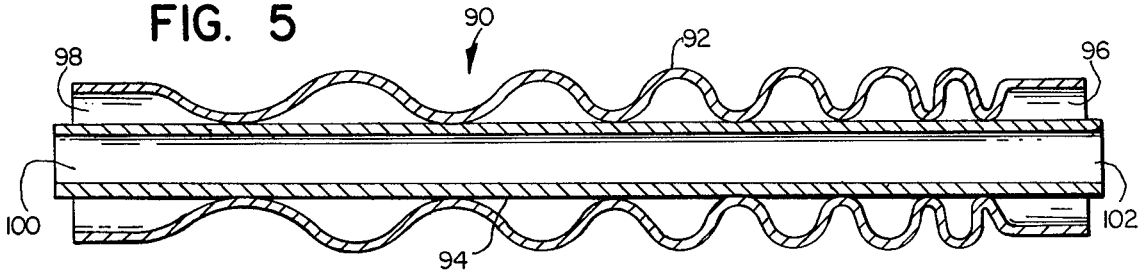
FIG. 5 is a cross sectional view of another heat exchanger employing a corrugated tube having graduated pitch.
Figure 6:
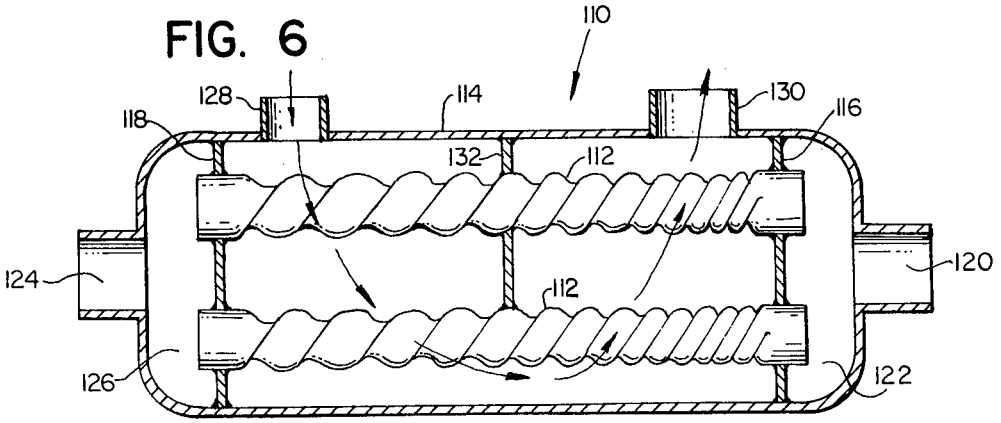
FIG. 6 is a cross sectional view of a shell-and-tube heat exchanger employing helically corrugated tubing with graduated pitch.

Examples of heat exchangers utilizing helically corrugated tubing with graduated pitch are shown in FIGS. 4–6.

Tube-in-tube heat exchangers are illustrated in FIGS. 4 and 5. Such exchangers can be manufactured in accordance with the present invention and a twisting process described in greater detail in U.S. Pat. No. 3,777,343 issued to D'Onofrio. In FIG. 4, the exchanger, generally designated 70, is comprised of an external cylindrical tube 72 and an internal helically corrugated tube 74. The corrugations on the tube 74 have a constantly increasing or graduated pitch between an inlet 76 at one end and an exit 78 at the opposite end. The exchanger 70 is formed coaxially so that the external tube 72 fits snugly in sealing relationship over the corrugations of the tube 74 and thereby defines a spiral flow path of variable cross section between the annular openings 80 and 82 at opposite ends of the exchanger.

The exchanger 70 could be operated in a reverse flow form by introducing a hot gas at the annular opening 80 to transfer heat to a cooler gas entering the exchanger at inlet 76. As the hot gas loses heat, it naturally contracts, and the reduced cross sectional area of the flow path between the tubes 72 and 74 accommodates this contraction. Conversely, the cooler gas entering the inlet 76 receives heat and expands, and the expansion is accommodated by an effective increase of the cross sectional area caused by the graduated corrugations.

In FIG. 5 another tube-in-tube exchanger generally designated 90 is illustrated. In this exchanger, the corrugated tube 92 with graduated pitch is mounted over a cylindrical internal tube 94. The cross sectional area of the helical flow paths between the tubes 92 and 94 varies in accordance with the pitch of the corrugations between the annular openings 96 and 98 at opposite ends of the exchanger. However, the cross sectional area of the internal tube 94 remains substantially constant between the inlet 100 and exit 102.

One method of operating the exchanger 90 directs a substantially non-expanding fluid such as a liquid through the internal tube 94 while an expandable medium such as a gas is transmitted through the helical flow paths between the tubes 92 and 94. Thus, a heated liquid may be transmitted between the inlet 100 and exit 102 while gas, such as air, is transmitted from the annular opening 96 to the opposite opening 98. As heat is transmitted from the liquid to the air through the wall of the tube 94, the increased pitch in the corrugations of the tube 92 allows natural expansion to occur without increasing the air velocity or pressure.

FIG. 6 illustrates a shell-and-tube heat exchanger 110 using helically corrugated tubing with graduated pitch. The exchanger 110 includes a bundle of helically corrugated tubes 112 which extend as conduits through a jacket 114 between end walls 116 and 118. At the end wall 116, the tubes communicate with an inlet 120 through a manifold chamber 122, and at the wall 118 the tubes communicate with an exit 124 through the manifold chamber 126. The jacket 114 contains an inlet 128, an exit 130, and an internal baffle 132 that directs fluid passing between the inlet 128 and exit 130 over the corrugated tubes as illustrated by the arrows.

It will be observed that the corrugations on all of the tubes 112 have a smaller or tighter pitch adjacent the end wall 116 and a larger or more open pitch adjacent the end wall 118. Thus, an expandable gas to be heated should enter the exchanger at inlet 120 and pass through the tubes 112 to the exit 124 while a heated fluid passes through the jacket 114 between the entrance 128 and exit 130.

The exchangers 70, 90 and 110 can be used in other manners and still take advantage of the changes in flow path cross section provided by the graduated corrugations. As described the exchangers function conventionally and accommodate normal contraction or expansion. However, they may be used as condensers or evaporators wherein a phase change takes place within one or both of the heat exchange fluids.

While the present invention has been described in a number of forms and embodiments, it will be understood that numerous modifications and substitutions can be had without departing from the spirit of the invention. For example, the process of manufacturing helically corrugated tubes with graduated pitch can be accomplished in a variety of manners. To manufacture tubing for heat exchangers it is suggested that the graduated pitch increase relatively constantly or linearly from one end of the corrugations to the other. However, it will be readily apparent that by suitable regulation of the twisting rate and axial forces, non-linear pitch variations can also be obtained. The process of stressing the tubes in order to provide "starts" for the corrugations can be accomplished externally of the twisting machine by suitable dimpling or pimpling equipment such as shown in U.S. Pat. No. 3,533,267. The heat exchangers composed of graduated pitch tubing can take a multitude of forms depending upon the particular function and fluids being handled. The corrugated tubing of the present invention can also be used apart from the heat exchanger field. For example, the graduated pitch may simply be used to vary the flow velocity of a fluid medium around another medium or object. Accordingly, the present invention has been described in several embodiments merely by way of illustration rather than limitation.

I claim:

1. A method of forming a spirally corrugated tube comprising the steps of:

providing a tube having a deformable metallic tube wall disposed about a tube axis;

applying localized pressure to the tube wall at locations corresponding to the corrugations desired in the wall;

twisting the tube about the tube axis while simultaneously applying axial directed forces to the tube to cause the metallic tube wall to be stressed and to deform from the areas of localized pressure and progressively develop spiral corrugations in the wall; and controlling the twisting and the axially directed forces in a variable ratio to continuously vary the pitch of the corrugations as the corrugations progressively develop in the tube wall.

2. A method of forming a spirally corrugated tube as defined in claim 1 wherein the step of controllably varying comprises varying the twisting torque on the tube at a substantially constant rate to vary the ratio of torque and force.

3. A method of forming a spirally corrugated tube as defined in claim 1 wherein the step of controllably varying comprises varying the axially directed force on the tube at a substantially constant rate.

4. A method of forming a spirally corrugated tube as defined in claim 1 wherein the step of controllably varying comprises varying the twisting torque and the axially directed force on the tube simultaneously.

5. A method of forming a spirally corrugated tube as defined in claim 4 wherein a further step includes: mounting the provided tube in a twisting machine having a rotatable chuck with one end of the tube engaged with the chuck and the opposite end restrained against rotation; and wherein the step of twisting the tube comprises rotating the chuck engaged with the tube and the step of controlling the twisting comprises varying the rate at which the chuck rotates the one end of the tube relative to the restrained end.

6. A method of forming a spirally corrugated tube as defined in claim 5 wherein the step of varying comprises varying the rate of chuck rotation continuously in the same sense or direction.

7. A method of forming a spirally corrugated tube as defined in claim 1 wherein an additional step comprises mounting the tube in a twisting machine having a headstock with a rotatable chuck and a tailstock, the headstock and tailstock being engaged respectively with opposite ends of the tube and being forceably movable toward and away from each other along the axis of the tube; and the step of twisting and simultaneously applying axially directed forces comprises rotating the chuck and simultaneously forceably moving the headstock and tailstock relative to one another; and the step of controlling comprises varying the forces with which the headstock and tailstock are forceably moved relative to one another.

8. A method of forming a spirally corrugated tube as defined in claim 7 wherein the step of varying the forces comprises constantly increasing the level of the axially directed force.

9. A method of forming a spirally corrugated tube as defined in claim 7 wherein the step of varying the forces comprises constantly decreasing the level of the axially directed force.

10. A method of forming a spirally corrugated tube as defined in claim 1 wherein an additional step in the method includes inserting a mandrel within the tube prior to the step of twisting and applying axially directed forces, the mandrel having one portion smaller than the inside, transverse dimensions of the tube and fitting in the tube in spaced relationship with the inside tube surface.

11. A method of manufacturing a helically corrugated section of tubing comprising the steps of:

installing a section of tubing in a turning machine having a rotatable chuck in a headstock and non-rotatable jaws in a tailstock which is movable along a turning axis toward and away from the headstock, the tubing section having one end engaged with the rotatable chuck of the headstock and the opposite end engaged with the non-rotatable jaws of the tailstock;

stressing the tube wall at selected points located between the ends of the tubing section in a plane transverse to the tube axis to reduce the resistance to deformation at the selected points;

rotating the chuck engaging the one end of the tube section relative to the jaws engaging the opposite end of the section while simultaneously forceably moving the tailstock toward the headstock to develop helical corrugations progressively along the tube wall; and selectively controlling the rate of rotation of the chuck and the force on the tailstock to develop helical corrugations in the tube wall having a continuously increasing pitch from one end of the corrugations to the other.

12. A method of manufacturing a helically corrugated section of tubing as defined in claim 11 wherein the section of tubing installed in the turning machine has an annular tube wall of circular cross section and an additional step in the process comprises positioning a mandrel having a diameter substantially less than the inside diameter of the annular tube wall in the tubing section during the simultaneous steps of rotating the chuck and forceably moving the tailstock to limit inward deformation of the tube wall.

13. A method of manufacturing as defined in claim 11 wherein the step of selectively controlling the rate of chuck rotation and the force on the tailstock comprises varying the rate of rotation while holding the force on the tailstock substantially constant.

14. A method of manufacturing as defined in claim 11 wherein the step of selectively controlling the rate of chuck rotation and the force on the tailstock comprises varying the force while holding the rate of rotation substantially constant.

15. A method of manufacturing as defined in claim 11 wherein the step of selectively controlling comprises varying the ratio of the rate of rotation and the force on the tailstock at a substantially constant rate.

16. A method of manufacturing as defined in claim 11 wherein the step of stressing the tube wall comprises stressing the tube wall at a plurality of equally spaced points in a plane transverse to the tube axis; and the simultaneous steps of rotating and forceably moving develop a plurality of helical corrugations respectively from the plurality of points.

* * * * *

UNITED STATES PATENT AND TRADEMARK OFFICE

CERTIFICATE OF CORRECTION

PATENT NO. : 4.171,634

DATED : October 23, 1979

INVENTOR(S) : Robert W. Perkins

It is certified that error appears in the above-identified patent and that said Letters Patent are hereby corrected as shown below:

Column 7, Line 15 "claim 4" should be --claim 1--.

Signed and Sealed this

*Fifteenth* Day of *January 1980*

[SEAL]

*Attest:*

SIDNEY A. DIAMOND

*Attesting Officer*

*Commissioner of Patents and Trademarks*